United States Patent [19]

Phillips

[11] Patent Number: 4,481,444

[45] Date of Patent: Nov. 6, 1984

[54] TRAVELING WAVE TUBES HAVING BACKWARD WAVE SUPPRESSOR DEVICES

[75] Inventor: Robert M. Phillips, Redwood City, Calif.

[73] Assignee: Litton Systems, Inc., Beverly Hills, Calif.

[21] Appl. No.: 247,452

[22] Filed: Mar. 25, 1981

Related U.S. Application Data

[63] Continuation-in-part of Ser. No. 246,835, Mar. 23, 1981, abandoned.

[51] Int. Cl.[3] ..... H01J 25/34

[52] U.S. Cl. ..... 315/3.6; 315/3.5; 315/39.3; 330/43

[58] Field of Search ..... 315/3.5, 3.6, 39.3; 330/43

[56] References Cited

U.S. PATENT DOCUMENTS

| | | | |
|---|---|---|---|
| 2,828,440 | 3/1958 | Dodds et al. | 315/3.6 |
| 2,889,487 | 6/1959 | Birdsall et al. | 315/3.6 |
| 2,971,114 | 2/1961 | Dow | 315/3.6 |
| 3,335,314 | 8/1967 | Espinosa et al. | 315/3.5 X |
| 3,366,897 | 1/1968 | Konrad | 315/3.5 X |
| 3,387,168 | 6/1968 | Beaver | 315/3.5 |
| 3,387,170 | 6/1968 | Farney et al. | 315/3.5 |
| 3,739,303 | 6/1973 | Veith et al. | 315/39.3 |
| 4,107,575 | 8/1978 | Vanderplaats et al. | 315/3.6 |
| 4,178,533 | 12/1979 | Ribout et al. | 315/3.6 |
| 4,185,225 | 1/1980 | Doehler et al. | 315/3.6 |
| 4,229,676 | 10/1980 | Manoly | 315/3.6 |
| 4,315,194 | 2/1982 | Connolly | 315/3.6 |

*Primary Examiner*—Saxfield Chatmon, Jr.
*Attorney, Agent, or Firm*—Gerald Landau Cline

[57] ABSTRACT

There is disclosed a traveling wave tube with a slow wave structure having means for frequency and directionally sensitive wave amplification. The slow wave structure includes a conductive helix coaxially mounted within a conductive tubular housing and a conductive support structure longitudinally disposed within the housing and extending transversely from the helix to the housing. In some embodiments, the support structure is combshaped and in one embodiment is a helical ridge wound in registration with and in the same sense as the helix. The pitch of the housing and a preselected parameter of the support structure are simultaneously varied along the length of the helix such that a wave at a given frequency band traveling along the slow wave structure in a first direction is preferentially amplified with respect to waves traveling in an opposite direction. In various embodiments discussed, the first direction is the direction of travel of the electron beam, thereby providing a traveling wave tube which operates as a forward wave amplifier in which backward waves are suppressed.

51 Claims, 19 Drawing Figures

TRAVELING WAVE TUBES HAVING BACKWARD WAVE SUPPRESSOR DEVICES

This is a continuation-in-part of patent application Ser. No. 246,835 filed Mar. 23, 1981, now abandoned.

TECHNICAL FIELD

This invention relates generally to microwave devices and in particular to traveling wave tubes having an improved type of slow wave structure, including such structures having means for providing both frequency and direction sensitive amplification.

BACKGROUND ART

The traveling wave tube is a type of microwave device which is widely used as a component of microwave electronic systems to both amplify and generate microwave frequency electromagnetic waves. In the traveling wave tube, a stream of electrons is directed along a slow wave structure of the device. A microwave frequency electromagnetic wave is made to propagate along the slow wave structure. This structure provides a path of propagation for the electromagnetic wave which is considerably longer than the axial length of the structure so that the traveling wave may be made to propagate axially at nearly the velocity of the electron beam. The interaction between the electron beam and the electromagnetic wave causes velocity modulations and bunchings of the electrons in the beam. Energy is thereby transferred from the electron beam to the electromagnetic wave traveling along the slow wave structure, thereby amplifying the electromagnetic wave.

One widely used type of slow wave structure used in traveling wave tubes is the coupled cavity structure. In this type of slow wave structure a series of interconnected cavities are aligned along a common axis. The electron beam passes along the axis through apertures in the cavities. One of the problems encountered in traveling wave tubes of the coupled cavity variety is the high cost of construction resulting from the fact that a coupled cavity tube uses many identical cavities each of which must be manufactured to a vary high precision. Another problem encountered in such tubes is that the well known impedence-bandwidth product (or equivalently, the gain per wavelength-bandwidth product) is somewhat reduced because the cavities tend to shield the electron beam from the fields over portions of the beam length thereby reducing the effective interaction between the beam and the traveling wave.

Another widely used type of slow wave structure is a helix which is usually supported within a tubular housing by means of a plurality of axially spaced dielectric rods equally circumferentially spaced about the helix. One of the desirable operating characteristics of such a slow wave structure is that it is capable of amplifying input microwave signals over an extremely broad bandwidth, typically an octave or more. However this very advantage of such a slow wave structure sometimes becomes one of its weaknesses because the bandwidth-impedence relationship is essentially a constant. Therefore, the dielectrically supported helix, having a large bandwidth, must necessarily have a low effective interaction impedence.

The smaller the interaction impedence, the smaller the radius of the slow wave structure must be in order that the wave to be amplified is in close proximity to the electron beam with which it is interacting. For example, a helix for operation at one-half centimeter wavelength has a diameter of several thousandths of an inch. Such a structure is too small to be practically constructed even if it were its power dissipation would be so small as to be virtually useless. Thus, although the dielectrically supported helix is a very practical circuit when amplifying waves longer than, for example, one or two centimeters in wavelength, at shorter wavelengths the resulting helix would be so small as to be highly difficult if not impossible to construct.

Another serious deficiency of the dielectrically supported helix is that it has a limited power output capability because the dielectric support rods can conduct away from the helix only limited amounts of heat generated by beams interception and r-f losses before damage results.

Ring-plane and helix-plane structures are two other types of slow wave structures that relate to the present invention, certain aspects of such structures being disclosed by R. M. White, et al., in an article in *IEEE Transactions on Electron devices,* June 1964, pages 247–261. The ring-plane circuit is a series of axially spaced rings connected by radial support planes. The helix plane circuit is a helix supported by radial support planes. In their article, White et al., reported that measurements on the ring-plane structure indicated a very narrow bandwidth which makes such a circuit impractical for most applications. The article also taught away from the helix-plane type of structure on the grounds that it had essentially the same narrow bandwidth as the ring plane circuit. One aspect of the present invention is the discovery that the bandwidth of helix-plane structures is moderately high, much higher than the measurements reported by White, et al.

A major problem in all traveling wave tubes when operated as forward wave amplifiers is that they exhibit unwanted oscillation modes caused by backward waves, electromagnetic waves on the slow wave structure which flow in the direction opposite to that of the signal being amplified. These backward waves flow in a direction opposite to the direction of motion of the electron beam and cause unwanted oscillations and spurious signals. This characteristic is a direct result of the ability of slow wave structures such as described above to support numerous oscillation modes and can occur no mater how well matched are the input and output ends of the tube to the slow wave structure. Heretofore, numerous techniques have been used to prevent unwanted backward wave oscillations in traveling wave tubes. These techniques include introducing frequency selective losses tuned to the backward wave oscillation frequency and discontinuities in the slow wave structure which create two or more backward wave oscillation frequencies so that the circuit lacks enough length to start the unwanted oscillations.

These techniques work to some extent when applied to small size circuits such as the dielectrically supported helix, in which most of the offending modes are well removed in frequency from the desired forward propagation mode. However these techniques suffer a number of disadvantages among which are increased structure complexity and the introduction of undesired loss in the forward wave to be amplified. Furthermore, such techniques tend to lose their effectiveness in circuits having larger transverse dimensions, such as the ring-plane and helix-plane circuits, because a large number of backward wave modes can be supported in the general frequency range of the desired mode.

SUMMARY OF THE INVENTION

Accordingly, it is an object of the present invention to provide a traveling wave tube having parts which are fewer in number and requiring lower fabrication tolerances to thereby lower the cost of manufacturing and increase the reliability of operation over prior art traveling wave tubes.

It is another object to provide a traveling wave tube which achieves increased interaction impedance and thereby higher gain per wavelength than prior art devices having comparable bandwidth.

Still another object is to provide such a device capable of operating at subcentimeter wavelengths in a size which can be readily manufactured.

Yet another object is to provide such a device having increased heat dissipation capability so as to be capable of operating at high output powers.

A further object is to provide such a device having means for providing frequency sensitive and directionally sensitive amplification within the slow wave structure.

A yet further object of the present invention is to provide such a device in which the amplification of backward wave power is attenuated without comparable attenuation of the desired forward wave power.

A further object is to provide such a device having a large bandwidth-impedence product in which both impedance and bandwidth are of moderate magnitude.

Still another object is to provide such a device having a large bandwidth-impedence product in which both impedence and bandwidth are adjustable over wide ranges.

These and other objects and advantages are accomplished in a traveling wave tube which includes means for providing an electron beam directed along the axis of a slow wave structure which is capable of exchanging energy between the electron beam and electromagnetic waves traveling along the slow wave structure. The slow wave structure comprises a helix disposed about the axis, a tubular housing coaxially disposed about the helix, and a support structure extending along the length of the helix and extending outwardly from the helix to attachment with the inner wall of the housing. The helix, housing and support structure are made of electrically conductive material.

Among the capabilities provided by such a structure are a high impedence-bandwidth product, adjustment of impedence and bandwidth over a broad range, ease of construction, and a high heat transfer to facilitate operation at high output power.

The pitch of the helix and another preselected parameter of the slow wave structure can be varied as a function of distance along the helix so that the wave at a given frequency traveling along the slow wave structure in a first direction is preferentially amplified with respect to waves traveling in an opposite direction. In the particular embodiments discussed the first direction is the direction of travel of the electron beam, thereby providing a traveling wave tube which operates as a forward wave amplifier in which backward traveling waves are suppressed.

In one embodiment of the invention, the support structure includes two comb-shaped members. Each member has a spine and an array of axially spaced-apart fingers projecting from the spine. The tip of successive ones of the fingers are connected to a respective turn of the helix and the spine is connected to the inner surface of the housing.

In another embodiment, the helix is provided with a helical hollow conduit through which can flow liquid coolant and which is wound in the same sense and is an integral part of the helix, thereby enhancing the capability for high power operation.

In still another embodiment, the pair of radially opposed comb-shaped support members differ from that of the first embodiment in that the length of the fingers are constant but the thickness of the transverse direction of each of the members varies along the length of the helix simultaneously with the variation in pitch of the helix.

In a yet further embodiment of the invention the helix has a base portion and a ridge portion which extends outwardly from the base portion to a tubular housing. The helix can be wound from a T-shaped ribbon so as to form, in effect, a pair of joined helices wound in the same sense.

Transverse portions of the ridge portion are removed on radially opposed sides of the helix so that the removed amount of transverse portions of the ridge material and the pitch of the helix vary simultaneously along the length of the helix to thereby provide the directional and frequency sensitive amplification.

In a further embodiment of the invention the helix is formed from two ribbons so as to form a bifilar helix.

BRIEF DESCRIPTION OF THE DRAWINGS

These and other objects, advantages and features will become more fully apparent from the following detailed description of the invention when considered in conjunction with the accompanying drawings in which:

FIGS. 5–9 are $\omega$-$\beta$ diagrams useful for explaining characteristics of the embodiment of the invention of FIGS. 1–4 as well as for all other embodiments to be described;

FIG. 19 is an orthogonal view of a slow wave structure having a bifilar helix in accordance with a further embodiment of the invention.

DETAILED DESCRIPTION OF THE DRAWINGS

Figure 1:
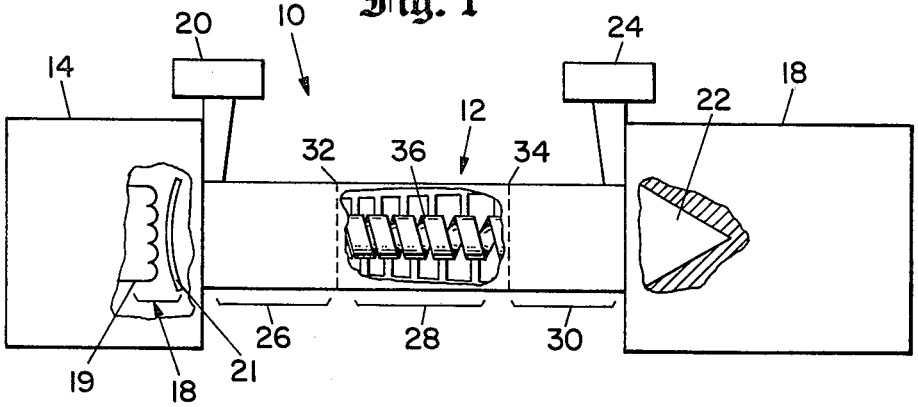
FIG. 1 is a simplified schematic diagram, partly in cross section, of a traveling wave tube constructed in accordance with one embodiment of the present invention.

Referring in greater particularity to the drawings, there is shown in FIG. 1 a simplified schematic section view of a traveling wave tube 10 in accordance with the invention. The traveling wave tube 10 includes a slow wave section 12 which is shown partially broken away, input section 14, and an output section 16.

Briefly described, the input section 14 includes an electron gun 18 of conventional design comprising a cathode 19 and accelerating electrode 21. Input section 14 also includes an input waveguide transducer 20 for coupling the traveling wave tube 10 to an external waveguide or other microwave transmission line (not shown) which provides the input microwave signal. Transducer 20 may also include a microwave window (not shown) transparent to microwave energy but capable of maintaining a vacuum within the traveling wave tube 10. The output section 16 includes a collector electrode 22 and a output transducer 24 which is substantially similar to the input transducer 20. Since all of these components are, with the exception of slow wave structure 12 conventional and by themselves form no part of the present invention no detailed description of these elements is given.

In operation, the electron gun 18 generates and accelerates a beam of electrons along the axis of the tube 10. The beam travels at a design velocity that is substantially equal to the axial velocity of an electromagnetic wave which is impressed upon the slow wave structure 12. The electron beam is conventionally focussed by a magnetic field parallel to the axis of the electron beam and can be supplied by either a solenoid (not shown) or by a series of permanent magnets (not shown) arranged along the length of the tube. The electromagnetic wave to be amplified is coupled from the input transducer 20 to the slow wave structure 12 and propagates along the length of the slow wave structure 12. The electron beam interacts with the slow wave structure 12 in such a way that the electrons give up some of their energy to the electromagnetic wave so that the wave on the structure grows in amplitude and appears at the output transducer 24. The electron beam arrives at the output at approximately the same time as the wave, exits from the structure, and is trapped in collector 22. Thus a steady energy interchange occurs in which the electron beam energy is given up to the electromagnetic wave. A faithful reproduction of the input is found at the output except that there has been a considerable gain in power.

In the embodiment of FIG. 1, traveling wave tube 10 is illustrated as having three amplifying sections 26, 28 and 30 where each amplifier section contains a slow wave structure 12. Each of the amplifier sections is isolated from the adjacent section or sections by means of an isolator device or sever. Thus the first and second amplifier sections 30 and 32 are isolated from one another by means of sever 32 and the second and third amplifier sections 28 and 30 are isolated from one another by means of sever 34. Each amplifier section 26 through 30 has a length appropriate for maximum stable gain. The severs 32 and 34 absorb the electromagnetic waves traveling along slow wave structure 12 while allowing the electron beam to pass through the entire length of traveling wave tube 10. The electron beam is modulated in each amplifier section and thus as it enters the subsequent amplifier section it launches a new electromagnetic wave which is amplified by interaction between the new electromagnetic wave and the electron beam. It is to be understood that the plurality of amplifier sections are shown solely for illustrative purposes, and that in traveling wave tubes of low power a single rather than multiple amplifying sections are typically used.

Figure 4:
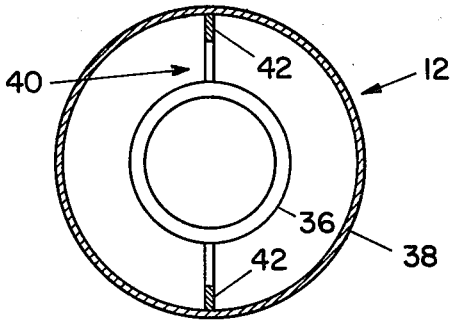
FIG. 4 is a transverse cross-sectional view taken along line 4—4 of FIG. 3.
Figure 3:
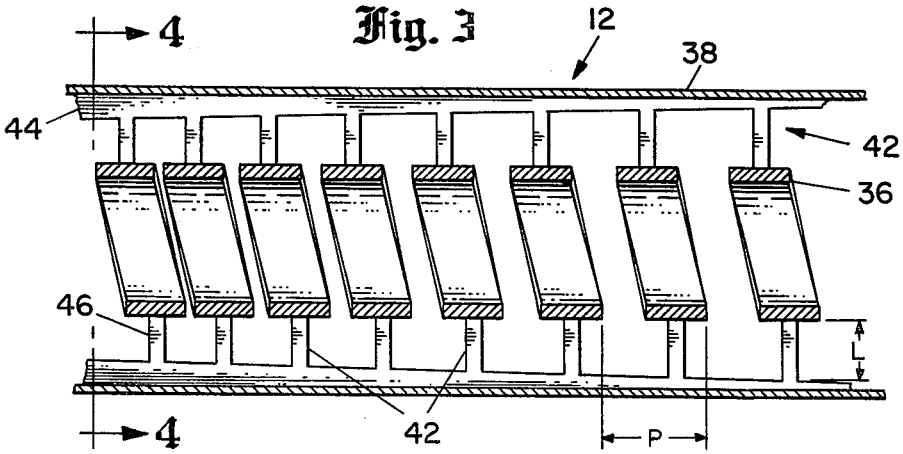
FIG. 3 is a longitudinal section view of one embodiment of a slow wave structure of FIG. 1 including a helix supported by comb-like structures.
Figure 2:
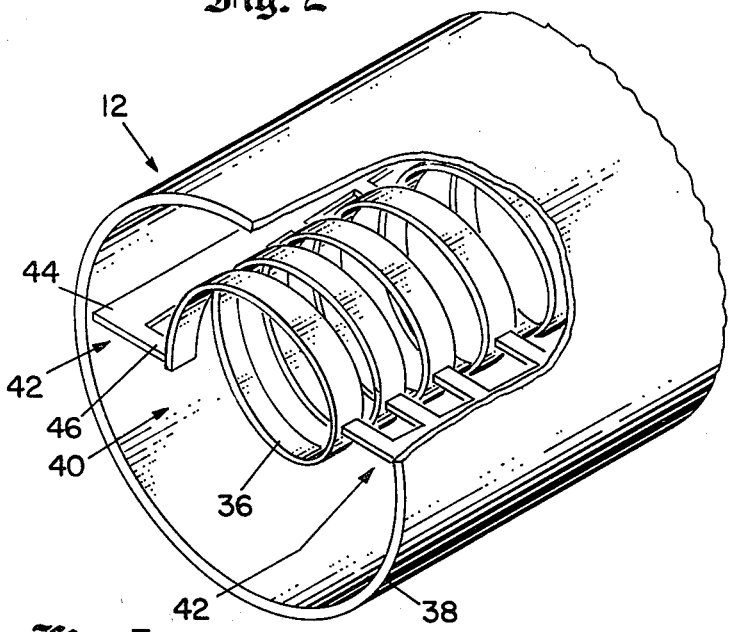
FIG. 2 is an orthogonal view of a slow wave structure of FIG. 1.

Referring to FIGS. 2, 3 and 4 there is shown in more detail one embodiment of the slow wave structure 12 used in the traveling wave tube of FIG. 1. The slow wave structure 12 includes a helix 36 formed from a ribbon which is wound with a predetermined pitch P between successive turns in accordance with desired wave propagating characteristics for the slow wave structure being fabricated. A tubular housing 38 is coaxially disposed about helix 35. The slow wave structure 12 further includes a support structure 40 extending along the length of the helix 36 and connected to the outer periphery of helix 36 at predetermined locations along the length of the helix 36 and extending outwardly to attachment with the inner wall of the tubular housing 38. Helix 36, housing 38, and support structure 40 are all made of electrically conductive material, suitably copper. In the particular embodiment illustrated in FIGS. 2, 3 and 4 the support structure is composed of a pair of comb-shaped members 42 each having a spine 44 with an array of axially spaced apart fingers 46 projecting from the spine 44. The tip of each of the fingers 46 is connected to a respective turn of helix 36. The tip of each of the fingers 46 is substantially centered on the width of a respective turn of the helix where the width is defined as the ribbon width along the length of the helix. The spine is connected to housing 38. As best shown in FIGS. 2 and 4, the comb shaped members 42 are mounted in opposing radial planes so as to form a longitudinal plane of symmetry.

As best shown in FIG. 3, the length L of fingers 46 and the pitch P of helix 36 are not constant but rather simultaneously increase along the length of helix 36 in the direction from left to right. For sake of clarity, the amount of variation is exaggerated here. Here the length L is defined by the length of a radial line along each of the fingers 46 extending from the tip of each finger to its intersection with the spine. An illustrative example of the change in pitch is ten percent from one end to the other of helix 36, while the length of the fingers 46 varies by approximately 13 percent.

The purpose of this variation is to overcome the problem of unwanted backward wave oscillations by modifying slow wave structure 12 in such a way that only the chosen forward wave mode propagates at the constant velocity required to achieve gain. It is one aspect of the invention that the pitch of the helix varies as a predetermined function of distance along the helix and another predetermined parameter of the slow wave structure 12 varies simultaneously with pitch so that a electromagnetic wave having a given temporal frequency which is traveling along the slow wave structure in one direction is preferentially amplified with respect to waves traveling along the slow wave structure in an opposite direction. Although the predetermined parameter of the slow wave structure that is varied in the embodiment of FIGS. 2, 3 and 4 is the length of fingers 46, the variation of other parameters can be substituted as will be described in further embodiments to be presented.

In order to explain the various propagation characteristics of the invention, including the backward wave suppression of the embodiment of FIGS. 2, 3 and 4, the well known $\omega$-$\beta$ type of dispersion diagrams will be used and are shown in FIGS. 5 through 9. As is conventional in such diagrams $\omega$, the angular frequency, is $$\omega=2\pi f$$

where f is the temporal frequency of wave propagation and $\beta$, the angular spatial frequency, is $$\beta=2\pi/\lambda$$

where $\lambda$ is the wavelength of the wave propagating on the slow wave structure 12. In addition the phase velocity $v_p$ of the electromagnetic wave is $$v_p=\omega/\beta$$

and the group velocity $v_g$ is $$v_g=\partial\omega/\partial\beta$$

Figure 5:
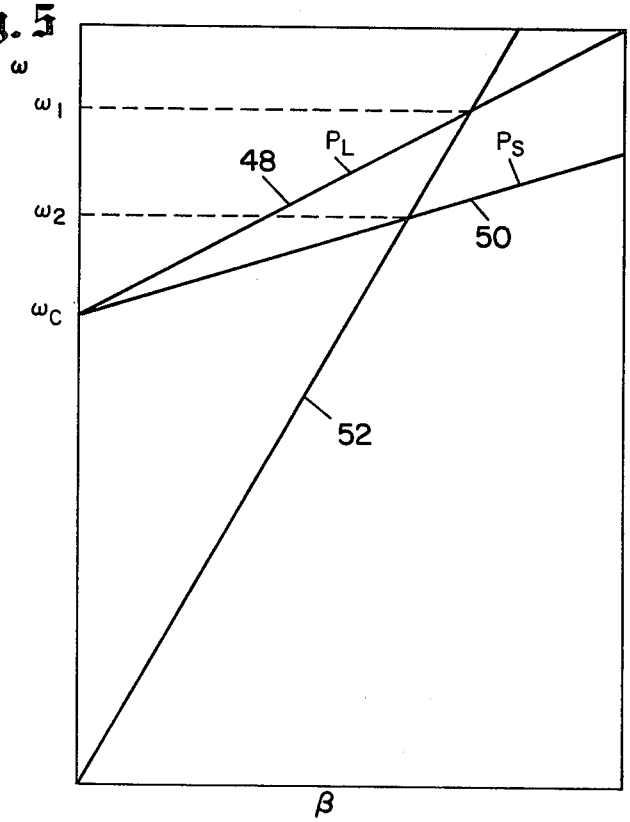

FIG. 5 shows a dispersion diagram for two slow wave structures 12 each of which is identical to that of FIGS. 2 through 4 except that the pitch of helix 36 and the length of fingers 46 do not vary but rather are a constant. Here, two slow wave structures are compared, one having a helix 36 with a long pitch $P_L$ designated with dispersion line 48, and the other having a helix 36 with a short pitch $P_S$ designated by line 50. It should be noted that lines 48 and 50 do not intercept the origin at $\omega=0$, but rather intercept at a non-zero cutoff frequency $\omega_c$, indicating that wave propagation along the slow wave structure is "forbidden" below $\omega_c$. Also shown is the electron beam velocity line 52 in which the slope is proportional to the velocity of travel of the electron beam. As is well known, the beam velocity is an increasing function of the voltage applied to accelerating electrode 19 in the electron gun of FIG. 1.

Where the beam velocity line 52 intercepts long pitch line 48 and short pitch line 50, the electron beam and the electromagnetic wave propagating on the slow wave structure 12 are equal in velocity and the interaction between the beam and the electromagnetic wave is at a maximum, thereby producing a maximum gain for electromagnetic waves at frequencies $\omega_1$ and $\omega_2$ propagating on the long pitch and short pitch helices respectively. At points away from the center frequency, the difference in velocity between the electromagnetic wave and electron beam progressively increases with a consequent lowering of gain at frequencies away from the center frequency. Thus the particular voltage at which the electron beam is accelerated determines the center frequency of a limited bandwidth, the center frequency progressively becoming lower as beam voltage is increased. Furthermore, the slow wave structure represented by long pitch line 48 has a greater slope than short pitch line 50 and thus provides a broader bandwidth than the slow wave circuit represented by the short pitch line 50. Thus, the pitch of the helix determines the bandwidth of the circuit.

Figure 6:
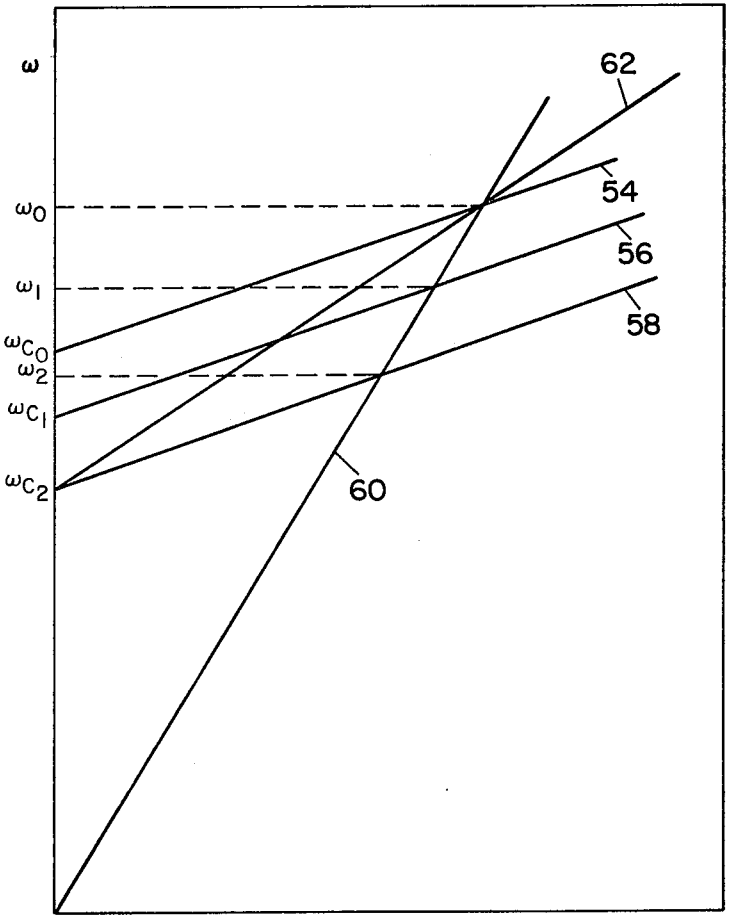
Figure 5:
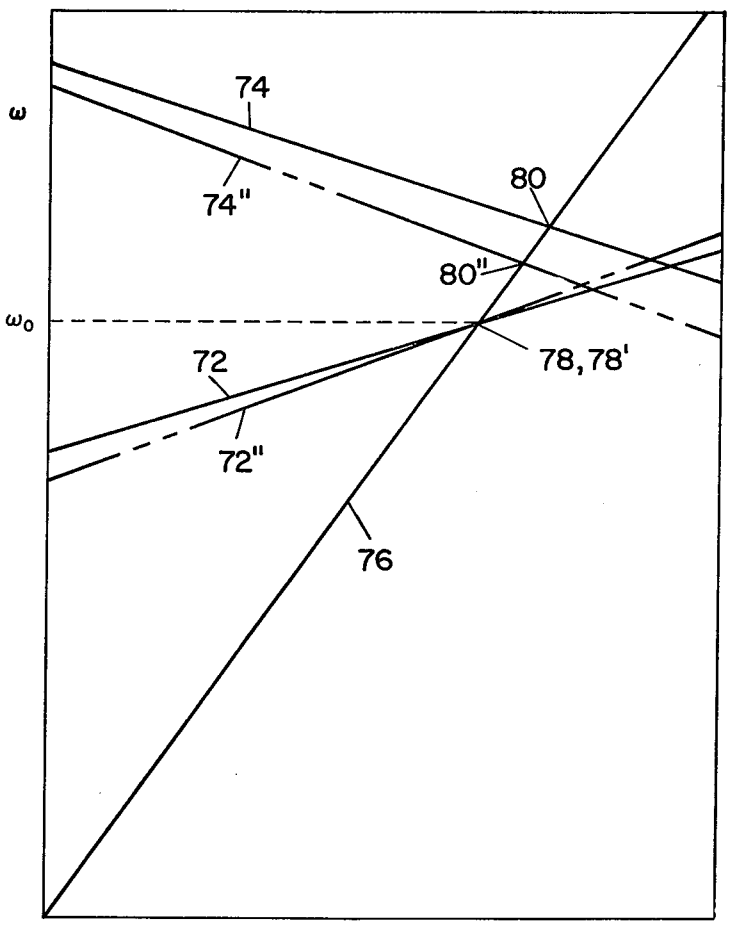
Figure 6:
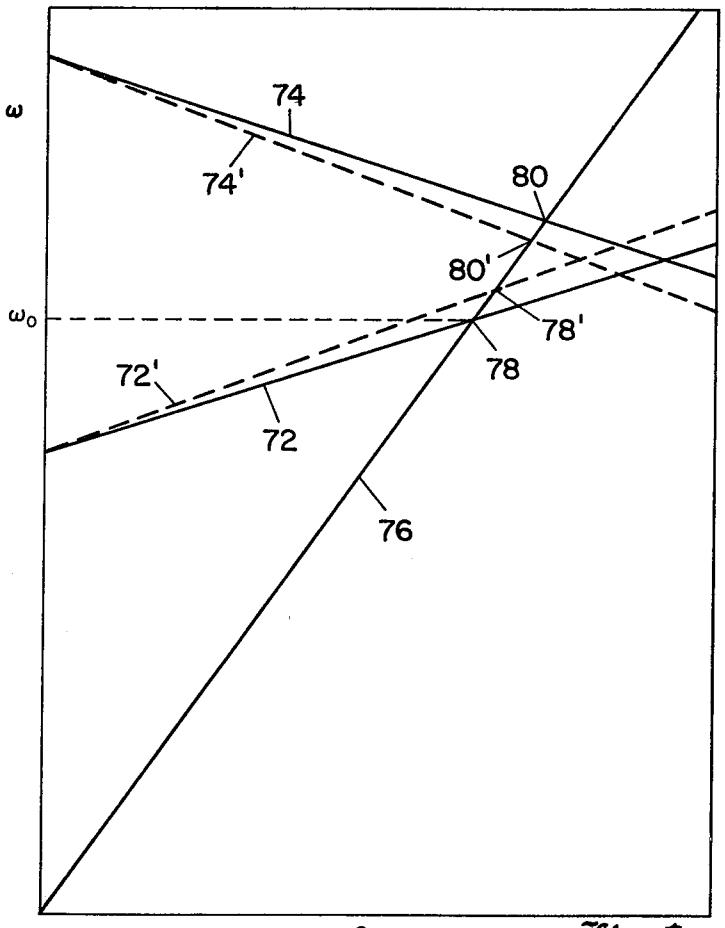

Referring now to FIG. 6, some of the advantageous effects of the comb-like structure 42 will now be explained. Lines 54, 56 and 58 are for three slow wave structures identical to that of FIGS. 2 through 4, except that for each of the respective structures the pitch of the helix and the lengths of the fingers are constant along the length of the structure. The constant lengths of the fingers are zero, short, and long for lines 54, 56, and 58, respectively. It should be realized that zero finger length refers to the case in which the inter-finger spacings are filled in so as to form an axially continuous support structure 40. As is apparent from inspection of FIG. 6, the effect of increasing finger length is to translate the dispersion lines downward without changing their slopes. As was explained for FIG. 5, each of the points of interception of the electron beam velocity line 60 with each of lines 54, 56 and 58 corresponds to the center frequency $\omega_0$, $\omega_1$, or $\omega_2$, respectively, of the bandwidth over which electromagnetic waves interact with the electron beam.

It is often desirable to have a tube operating at as high a bandwidth as possible for a given operating frequency $\omega_0$ and voltage of the electron beam. In the present invention such a high bandwidth can be achieved at a given operating frequency and lengthening the fingers and at the same time increasing the pitch of the helix so as to produce an operating characteristic shown by line 62. In this case the bandwidth is increased over that of a structure having the zero length fingers of line 54 because slopes of voltage line 60 and the long fingers, long pitch of line 62 are more nearly equal than are the slopes of voltage line 60 with the zero length finger, short pitch line 54.

One of the advantages of the invention over the prior art is that the length of fingers 46 and pitch of the helix 36 can be independently adjusted so as to achieve just the desired bandwidth for needed operating frequency and electron beam voltage. For example, as an inspection of FIG. 6 makes apparent, if no slots were used then a desired high bandwidth could be achieved only by simultaneously increasing the pitch of helix 36 and operating at a higher electron beam voltage. Often such an increase in voltage is not possible because of system limitations.

With the invention as with the prior art, a trade off exists between the desirable characteristics of high impedence and high bandwidth. The reason for the trade off is that the product of impedence (or equivalently, gain per wavelength) and bandwidth is essentially a constant for a given slow wave structure of the invention that it has a higher impedence than the prior art coupled cavity because, unlike the coupled cavity structure, the electromagnetic fields propagating along the slow wave structure of the invention are not partially shielded from interacting with the electron beam.

It is a further advantage of the invention that in constrast to the intrinsically low impedence and high bandwidth of the dielectrically supported helix, the slow wave structure of the invention has the capability of combining a moderate bandwidth with moderate impedence.

As is known to those familiar with the art, the performance of a traveling wave tube is determined in significant part by the familiar factor $\gamma a$ where $\gamma$ is the radial propagation constant of the slow wave structure and a is the radius of the slow wave structure. In subcentimeter wave tubes, it is important to make the radius and the pitch as large as possible for ease of fabrication. However, the larger the factor $\gamma a$, the smaller is the interaction impedence. Thus, in the prior art a compromise has to be made between the conflicting requirements of reasonably large circuit size and reasonably high impedence. In accordance with the present invention, this compromise is less severe because of the high impedence which allows the circuit to be designed with a sufficiently large transverse dimension to enable the fabrication of subcentimeter wavelength slow wave structures.

Figure 7:
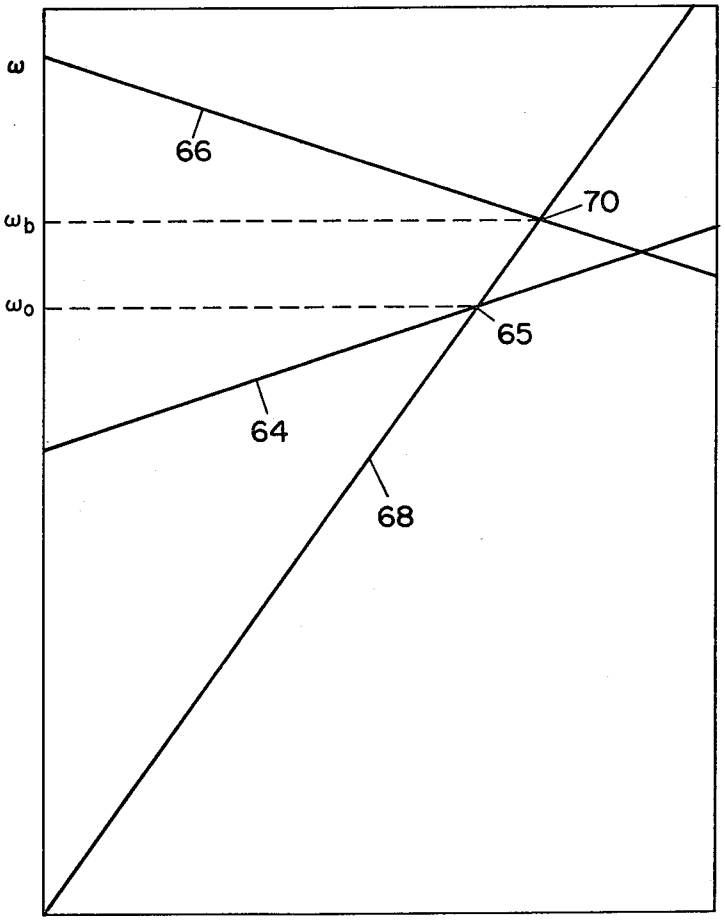

Referring to FIGS. 7, 8 and 9, the suppression of backward wave oscillations by simultaneous variation of finger length and helix pitch along the length of slow wave structure 12 will now be discussed.

FIG. 7 shows the dispersion curve for a slow wave structure similar to that of FIGS. 2 through 4, but again with the difference that the pitch and slot length are held constant with distance along helix 36. Line 64 is the forward traveling wave (group velocity positive) and 66 represents the backward traveling wave (group velocity negative). Line 68 is the beam velocity line whose slope, the beam velocity, is selected so as to intercept forward wave line 64 at interception point 65 so as to provide a structure capable of amplifying forward waves in the frequency range about a desired center frequency $\omega_0$. This is the desired mode of operation. Unfortunately, the interception of beam line 68 with backward wave line 66 at interception point 70 will give rise to an unwanted backward wave oscillation frequency at $\omega_b$. In general, the backward wave has a higher interaction impedence with the electron beam than the forward waves, thereby coupling a significant amount of the energy of the electron beam into an oscillation of the unwanted backward wave at the expense of energy in the desired forward wave.

Therefore, unless the slow wave structure of FIG. 7 having constant pitch and constant finger length is modified, it will oscillate at the frequency $\omega_b$ defined by the intercept point 70, rather than properly amplified at the frequency $\omega_0$ defined by the intercept point 68.

So far we have been discussing dispersion diagrams for slow wave structures in which helix pitch and finger length are held constant along the helix length. We now take up consideration of FIG. 8 which shows the dispersion characteristics of an embodiment similar to the invention of FIGS. 2 through 4, except that only the helix pitch, but not the finger length, varies along the helix length. Each of the two pairs of dispersion lines 72, 72' and 74, 74' respectively represent dispersion characteristics for forward waves and backward waves, at opposite ends of the same slow wave structure. Positions along the slow wave structure intermediate the two ends have dispersion lines (not shown) which lie between the two lines making up each pair.

As a first step in a two step solution to the problem of unwanted backward wave oscillations, FIG. 8 shows that the dispersion lines for forward and backward waves change slope in opposite directions as the helix pitch varies along its length . Thus, the dispersion lines for the forward wave varies from line 72 corresponding to the shorter pitch end of the helix to line 72' corresponding to the longer pitch, opposite end of the helix in a behavior similar to that already discussed with respect to FIG. 5.

Still referring to FIG. 8 the dispersion lines for the backward wave varies from line 74 at the shorter pitch end to line 74' at the longer pitch end of the same helix.

A physical explanation of the behavior of the shifts in slope with varying helix pitch can be presented from the facts that the slope of each line represents an axial velocity of the propagating wave at that transverse section of the helix and that the waves follow the circuitous path of the helix. Therefore in the case of a forward traveling wave, the increasing velocity of the wave with increasing pitch is a result of there being fewer turns per unit length for the wave to follow with a consequent increase in axial velocity. On the other hand in the case of the backward traveling wave, the wave encounters an increasing number of turns per unit length which result in a slower axial velocity.

The electron beam velocity line 76 intercepts line 72, 72', 74, and 74' at intercept points 78, 78', 80, and 80', respectively. For sake of discussion we assume that it is desired to amplify forward waves at a frequency $\omega_0$ corresponding to the intercept point 78.

Without further modification to the structure represented by FIG. 8 in which the pitch is the only structural parameter that varies, the slow wave structure is not capable of amplifying either forward or backward traveling waves. The reason is that any forward wave having a frequency within a frequency range corresponding to range from intercept point 78 to 78' would not be at an equal velocity to, and hence unable to interact with, the electron beam along a sufficient axial distance to produce wave amplification. A similar argument holds true for the backward wave.

We now proceed to consider FIG. 9 which shows the characteristics of the actual embodiment of the invention of FIGS. 2 through 4. Not only the helix pitch but also the length of fingers varies along the helix length. Here the finger lengths are varied along the length of the helix by a predetermined amount such that the dispersion line 72' of FIG. 8 is translated downward sufficiently to return the interception point 78' into coincidence with interception point 78. Such a variation in finger length leaves the slopes of all lines unchanged and they are simply translated downward with increasing finger length. In FIG. 9, line 72 and 72" represent the forward wave dispersion lines for opposite ends of the helix having shorter pitch and shorter fingers and the opposite end having longer pitch, longer fingers, respectively. Similarly, lines 74 and 74" represent the backward wave dispersion lines at the end of the helix having shorter pitch, shorter fingers and the opposite end of the helix longer pitch and longer fingers, respectively. Line 74 and 74" intercept beam line 76 at intercept points 80 and 80" respectively.

As is apparent from inspection of FIG. 9, intercept point 78 and 78" coincide at a frequency corresponding to $\omega_0$ while the backward wave frequencies swing through the still wider excursion corresponding to the range from intercept point 80 to intercept point 80". Thus, the forward wave propagating at a center frequency $\omega_0$ defined by the coincident intercept points 78, 78" is in synchronism with the electron beam velocity along the entire length of the slow wave structure 12. By contrast, the backward wave attempts to oscillate over the broad; frequency range defined by the interception points 80, 80" with the result that there is insufficient amplification in any given increment of helix length to produce a backward wave oscillation. The result is a preferential amplification of the forward traveling wave such that any backward wave has a negligible energy compared to the energy of the forward wave.

The above described method for suppression of unwanted backward wave oscillations appears to be equally effective no matter whether the simultaneous variations of helix pitch and finger length are mutually increasing or mutually decreasing function with respect to the direction of travel of the electron beam. Thus, in the embodiment of FIGS. 2 through 4, assume the slow wave structure 12 has the pitch of the helix 36 and the length of the fingers of the support structure as mutually increasing functions in the direction of the travel of the electron beam. However, if the slow wave structure 12 of FIGS. 2 through 4 was reversed end to end, then the pitch of the helix and length of the fingers would mutually decrease as a function of distance along the helix in the direction of travel of the electron beam and the suppression of backward waves would be equally satisfactory. The dispersion diagram for the latter situation would be completely analagous to that of FIGS. 5 through 9 except that the dispersion lines would undergo opposite changes in slope and translation as a function of distance along the helix. With these differences, the previous discussions concerning forward wave propagation and backward wave suppression given for FIGS. 5 through 9 would remain otherwise identical. For example, FIG. 9 would change to the extent that line 74 and 74" would be interchanged and lines 72 and 72" would similarly be mutually interchanged.

Figure 10:
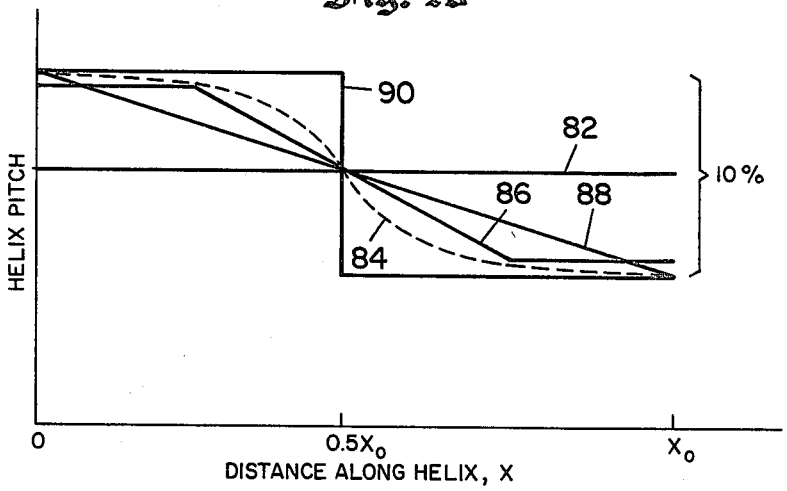
FIG. 10 is a graph illustrating various alternative functions of variation of helix pitch as a function of distance along the helix.

The pitch of the helix and the length of the fingers can vary as a number of different functions of distance along the length of the helix. FIG. 10 shows a number of alternative examples of the variation of helix pitch for various functions of distance along the helix. Line 82 shows a base-line, uniform helix pitch for reference. Other lines are for an end to end helix pitch change of mutually equal amounts of approximately ten percent. In each case, the length of the fingers vary in such a way as to leave a forward wave velocity uniform along the length of the helix at a frequency corresponding to the point of interception of the beam velocity length and the forward wave dispersion line. Such finger length variations have the substantially same functional form as the functions shown in FIG. 10 for variation of helix pitch and would have a somewhat greater magnitude of variation than the helix pitch. wave amplification but can be difficult to fabricate. Line 86 is a linearized version of a cosine variation in which the pitch is uniform for the first one-quarter of the circuit, a linear taper for the central one-half of the circuit length, and additional uniform pitch at the shorter pitch for the final one-quarter of the circuit length. Line 88 is a linear variation. Less effective, but still effective for backward wave suppression is the use of discrete steps in place of uniform variation in pitch and finger length. One example is shown in line 90 in which the circuit is divided into two equal lengths with a one step change in pitch. Of course, rather than the one step change, two, three or more steps would be more effective. The linear taper of line 88 represents a good compromise between the optimum backward wave suppression of cosine curve 84 and ease of manufacture.

A typical example of the embodiment of FIGS. 2 through 4 which has been built and successfully operated has a linear variation of pitch and finger length with a total variation of pitch between opposite ends of the helix of approximately 10 percent and the ratio of total variation of finger length to helix pitch of approximately 13%. Analyses have shown that the total variation of pitch can range from 6 percent to 25 percent while the ratio of total variation of finger length to helix pitch can range from approximately 1.1 to 1.7.

The construction of slow wave structure 12 is done by conventional manufacturing methods, such as, for example, winding the helix 36 on a mandrel using a commercially available numerically controlled helix winder. The winding of a helix having a variable pitch is no more difficult with such a machine than is the winding of a helix with a uniform pitch. Manufacture of the comb-like support structure 42 is readily accomplished by using well known electric discharge machine (EDM) methods. If the EDM device is one having computer controls, then once the machine is programmed the comb-like structure 42 having variation in spacing and length of the fingers can be made with no greater difficulty than that required to produce an equivalent support structure having uniform spacing and length.

As one advantageous aspect of the invention, it has been determined that as the cross sectional area of each of the fingers 44 is decreased, the value of the cutoff frequency $\omega_c$ is also decreased, thereby increasing the operating bandwidth and in addition increasing the bandwidth-impedance product. Of course, as the cross sectional area decreases the heat dissipation capability also decreases hence decreasing the output power capability of the TWT. Thus a tradeoff between impedance-bandwidth product must be made for the embodiment of FIGS. 2 through 4.

One way to adjust this trade off in favor of greater output power is by a simple modification to the embodiment of FIGS. 2 through 4 wherein the cross sectional area of each of the fingers 46 is increased by increasing the width of each of the fingers 46 along the axial direction of the helix. In an extreme case, the fingers 46 and spine 44 would merge to form a continuous radial plane. In such a configuration, since finger length would not be varied, an alternate means of backward wave suppression would be required.

At the other trade off extreme the gain-bandwidth product can be maximized by reducing the cross sectional area of each of the fingers 46 until each of the fingers 46 are toothpick-like.

At the ultimate extreme spine 44 can be eliminated, again requiring alternate means of suppressing backwave wave oscillations.

Figure 11:
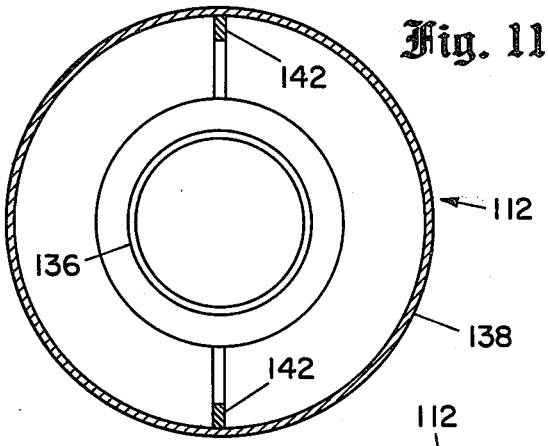
FIG. 11 is an end view of another embodiment of a slow wave structure similar to that of FIG. 2 with the addition of cooling means.
Figure 12:
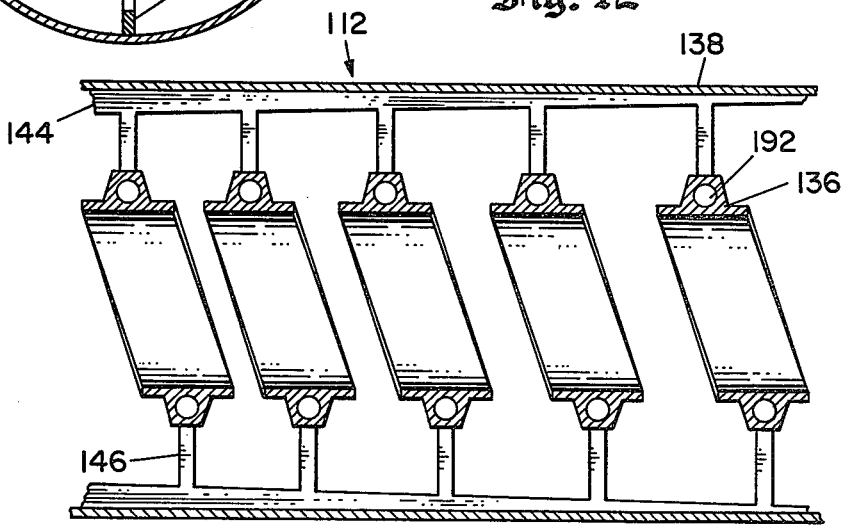
FIG. 12 is a longitudinal cross-sectional view of the structure illustrated in FIG. 11.

The need for this type of trade off is reduced if not eliminated by another embodiment of the invention as shown in FIGS. 11 and 12

The slow wave structure of FIGS. 11 and 12 is similar to the slow wave structure illustrated in FIGS. 2, 3 and 4 but differs from that structure in that the helix is provided with a means for the flow of a cooling liquid through the helix. Components in the embodiment of FIGS. 11 and 12 which are the same as, or equivalent to, respective components in the embodiment of FIGS. 2, 3 and 4 are designated by the same second and third reference numeral digits as their corresponding components in FIGS. 2, 3 and 4 with the addition of a prefix numeral "1". Referring to FIGS. 11 and 12 the slow wave structure 112 includes a helix 136 having a hollow conduit 192 for the flow of a cooling fluid through the helix. Conduit 192 is helical and is wound in the same sense as and an integral part of helix 136.

Figure 13:
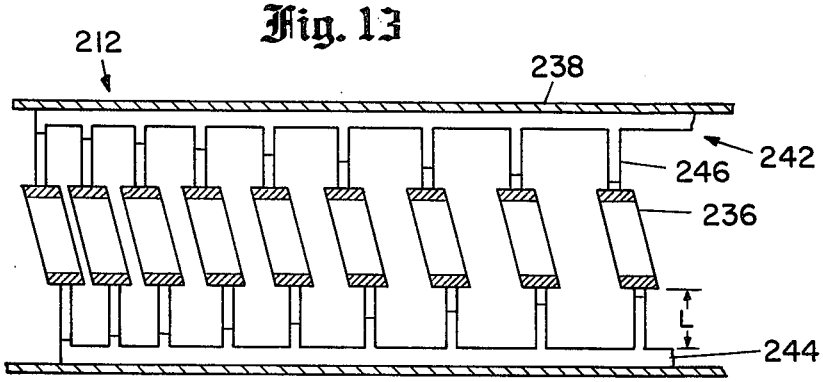
FIG. 13 is a longitudinal section view of a slow wave structure in accordance with still another embodiment of the present invention.
Figure 14:
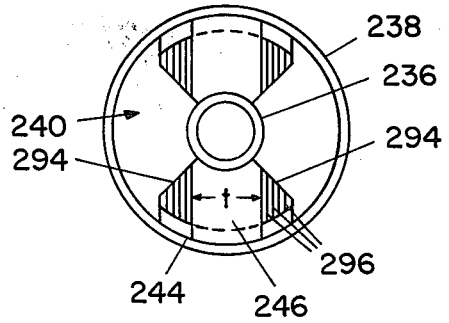
FIG. 14 is an end view of the structure illustrated in FIG. 13.
Figure 15:
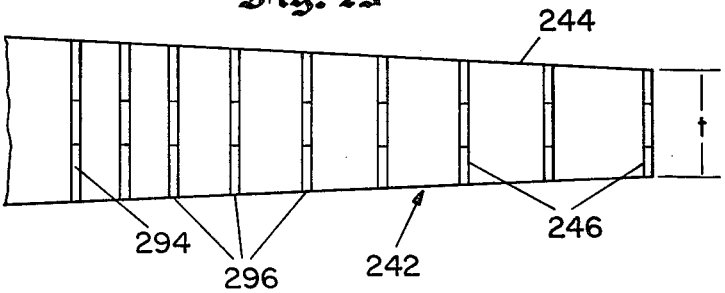
FIG. 15 is a top view of one of the pair of comb-shaped members shown in FIG. 13.

A further embodiment of the invention especially suited to higher power operation without the need for cooling is illustrated in FIGS. 13–15, wherein components which are the same as or equivalent to respective components in the embodiment of FIGS. 2 and 3 are designated by the same second and third reference numeral digits as their corresponding components in FIGS. 2 and 3 along with a prefix numeral "2".

The embodiment of the slow wave structure 212 of FIGS. 13 through 15 is similar to the embodiment illustrated in FIGS. 2 through 4, especially in that it is provided with a helix 236 having a pitch increasing along its length from left to right, a housing 238, and a pair of radially opposed comb-shaped support members 242 having a longitudinal plane of symmetry. However, the embodiment of FIGS. 13 through 15 differs from that of FIGS. 2 through 4 in that the length of fingers 246 are constant along the length of helix 236 but the thickness of the transverse dimension of each of the comb-shaped members 242 vary along the length of helix 236 in a manner shown.

As can best be seen in FIG. 15 each of the tips of the fingers 246 include a concave portion conforming to the curvature of the outer periphery of the helix 236. The convex outer portion of spine 244 conforms to the curvature of the inner surface of housing 238. A portion of each of the fingers 246 define a pair of edge surfaces 294 radially disposed to the slow wave structure 212 and symmetrical to the longitudinal plane of symmetry. Each pair of edge surfaces 294 subtend an angle substantially 90 degrees at the axis of the helix. Each of fingers 246 further includes a pair of substantially mutually parallel edge surfaces 296 which are coextensive with spine 244 and substantially parallel to the longitudinal plane of symmetry.

The thickness t of fingers 246 decreases and the pitch of helix 236 simultaneously increases along the length of helix 236 in the direction, as viewed in FIG. 13, from left to right. Here, the thickness of each finger 246 is defined by the perpendicular distance between each pair of edge surfaces 296. It is this variation of pitch and thickness that provides backward wave suppression in a manner entirely analogous to that described for the earlier embodiments. For example, the dispersion diagrams for the embodiment of FIGS. 13 through 15 would be qualitatively similar to FIGS. 5 through 9 and the dispersion lines for those Figures would be translated downward by progressively decreasing the thickness of FIGS. 246. The helix pitch and finger thickness can vary as the same various alternative functions previously shown in FIG. 10.

Because the cross sectional area of the comb-like members 242 is greater than in the prior described embodiments, more heat can be conducted away from helix 236 thus enabling operation at higher output powers without the need for liquid cooling.

An illustrative example of one version of the slow wave structure 212 of the embodiment of FIGS. 13–15 operates at an output wavelength in the sub-centimeter range and has a length of 1.2 inch, a helix 236 with an outer diameter of 0.057 inch, a support structure 240 with an outer diameter of 0.138 inch, a total helix pitch variation of 13.1 percent and a ratio of total thickness variation to pitch variation of 2.3. In other versions, the pitch can vary from approximately 6 percent to 25 percent and the ratio of variation of thickness to pitch can vary from approximately 1.8 to 2.8.

Figure 16:
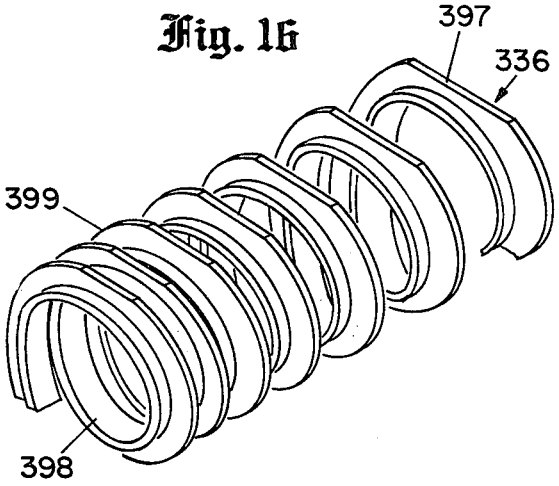
FIG. 16 is an orthogonal view of a slow wave structure (with the tubular housing removed for clarity of illustration) constructed in accordance with yet another embodiment of the invention.
Figure 17:
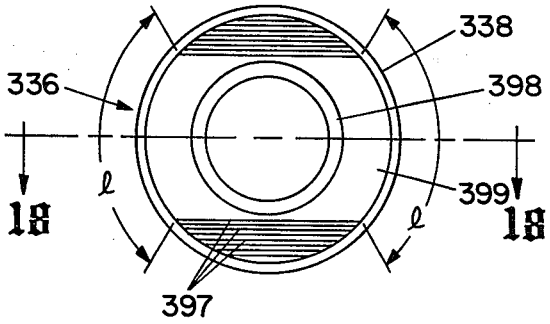
FIG. 17 is an end view of the embodiment of FIG. 16.
Figure 18:
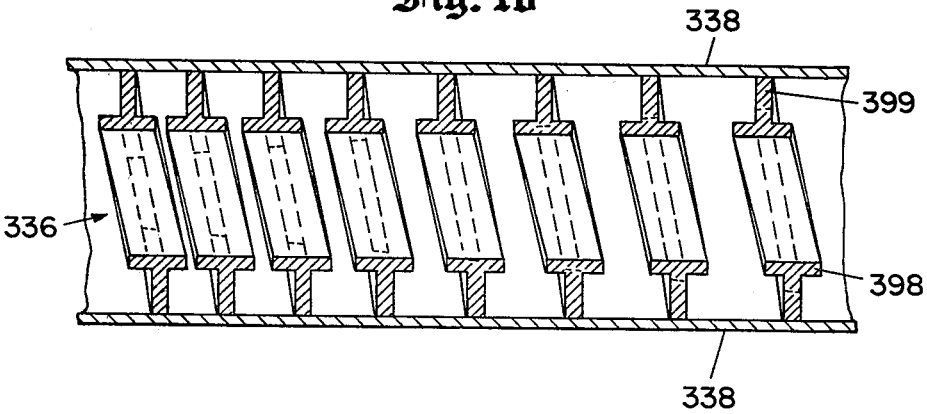
FIG. 18 is a longitudinal section view taken along line 18—18 of FIG. 17.

A yet further embodiment of the invention is illustrated in FIG. 16 through 18, wherein components which are the same as, or equivalent to, respective components in the embodiment of FIGS. 2 through 4 are designated by the same second and third reference numerals along with a prefix "3". Referring to FIGS. 16 through 18, a ridged helix 336 is wound from a T-shaped ribbon having a base portion 398 and a transverse ridge portion which extends outwardly from the base portion 398 to a support structure 338. The width of ridge portion 399 is less than the width of the base portion 398 such that the base portion 398 defines longitudinally extending portions on both sides of the ridge portion 399. The ridge portion 399 serves as a support structure 340 between helix 336 and tubular housing 338. Helix 336 can be wound on a mandrel using a T-shaped ribbon. However, alternatively, a pair of individual ribbons of the desired relative widths may be used to separately form the base portion 398 and the ridge portion 399.

As shown in FIG. 16 through 18, transverse portions of ridge portion 399 on successive turns of helix 336 are removed on longitudinally staggered but otherwise radially opposed locations of helix 336 so that the amount of transverse portions of ridge material removed and the pitch of the helix simultaneously increase in a direction as viewed in FIG. 16 from left to right. One parameter that can be varied to remove ridge portions is the arctuate distance 1 shown in FIG. 17. Another parameter that can be varied is the transverse area of the support members 340. Alternatively, the thickness dimension defined by the perpendicular distance between each pair of the radially opposed planar surfaces 397 can be varied. Any one of these parameters can be varied as functions shown in FIG. 10 to provide backward wave suppression in a manner again entirely analogous to that described for the earlier embodiments.

The embodiments of the invention discussed so far have shown a single helix. Such a helix can be designated a "monofilar helix." However, the invention can also comprise a helical structure of two or more helices. FIG. 19 is an orthogonal view of a further embodiment of the invention in which components which are the same as or equivalent to respective components in the embodiment of FIGS. 2–4 are designated by the same second and third reference numeral prefixed with a "4". Referring to FIG. 19, the slow wave structure 412 is similar to that of FIGS. 2–4 except that a helical structure 436 consists of two helices 4102 and 4104, respectively, each wound in the same sense and with the same diameter and axially interleaved as shown. Such a helical structure is designated a "bifilar helix."

As shown in FIG. 19, the pitch of a bifilar helix is defined by the spacing of every alternate turn rather than the spacing of every successive turn as in the case of a monofilar helix. An advantage of the embodiment of FIG. 19 is that the bifilar helix produces a significantly higher impedance-bandwidth product than does the monofilar helix.

For simplicity of illustration, the embodiment of FIG. 19 does not show a variation in pitch of the helix 436 or length of the fingers 444 along the length of the helix 436. However, such a variation could be advantageously used to suppress backward wave oscillations in a manner completely analogous to that of the previously discussed embodiments.

A helix formed from more than two ribbons, i.e., a trifilar or quadrifilar, etc., helix can also be used.

Although the present invention has been described with reference to particular devices, numerous modifications will be obvious to those schooled in the art. Therefore it is intended that such modifications shall lie within the spirit and scope of the invention as claimed in the appended claims. It is obvious, for example, that any of the embodiments described above can be modified so that the pitch of the helix and the predetermined parameter of the slow wave structure are constant rather than varying functions along the length of the helix. Such configuration would not by itself provide directionally sensitive amplification, e.g., backward wave suppression. However such suppression can be accomplished by using any one of a number of known prior art devices for suppressing backward wave oscillation.

In addition, it is obvious that such a constant pitch slow wave structure need not be limited to use as a forward wave amplifier but could be used for example, as a backward wave oscillator.

I claim:

1. A traveling wave tube comprising:

(a) means for providing an electron beam directed along an axis, said electron beam traveling in a first direction;

(b) an electrically conductive slow wave structure including (1) a helix disposed along and about said axis;

(2) tubular housing coaxially disposed about said helix; and (3) a support structure for said helix;

(c) the pitch of said helix varying as a predetermined function of distance along said helix; and (d) a preselected parameter of said support structure varying as a function of distance along said helix in a set relationship to said varying of said pitch of said helix such that for a first wave traveling along said slow wave structure having its phase velocity and group velocity along said first direction, the change in phase velocity caused by said varying of said pitch tends to cancel the change in phase velocity caused by said varying of said parameter of said support structure so as to result in a sufficiently uniform phase velocity as a function of distance along said slow wave structure to favor amplification of said first wave, whereas for a second wave traveling along said slow wave structure having its phase velocity along said first direction and its group velocity along the opposite direction, the change in phase velocity caused by said varying of said pitch is additive to the change in phase velocity caused by said varying of said parameter of said support structure so as to result in a sufficiently non-uniform phase velocity as a function of distance along said slow wave structure to suppress said second wave.

2. The device of claim 1 wherein said pitch of said helix increases in said first direction as said predetermined function of said distance along said helix.

3. The device of claim 1 wherein said pitch of said helix decreases in said first direction as said predetermined function of said distance along said helix.

4. The device of claim 1 wherein said support structure includes two comb shaped members extending in a direction parallel to the length of said helix and mounted substantially diametrically opposite to said helix within said tubular housing so as to form a longitudinal plane of symmetry containing said axis, each comb-shaped member having a spine portion and an array of axially spaced-apart fingers projecting from said spine.

5. The device of claim 4 wherein, in each of said comb shaped members, the tips of successive ones of the fingers are connected to respective ones of said successive turns of said helix, with said spine connected to said tubular housing.

6. The device of claim 5 wherein each tip of each of said fingers is longitudinally centered on and no wider than the width of the connected one of said successive turns of said helix.

7. The device of claim 5 wherein said preselected parameter of said support structure is the length of each of said fingers, said length of successive ones of said fingers varying along said length of said helix.

8. The device of claim 7 wherein said pitch of said helix increases as said predetermined function of said distance along said helix in said first direction and said length of successive ones of said fingers increases along said helix in said first direction.

9. The device of claim 7 wherein said pitch of said helix decreases as said predetermined function of said distance along said helix in said first direction, and said length of successive ones of said fingers decreases along said helix in said first direction.

10. The device of any one of claims 1 through 9 or 5 wherein said helix is provided with conduit means for the flow of a cooling fluid in thermal contact with said helix.

11. The device of claim 10 wherein said conduit means is a helix wound in the same sense as an integral part of said helix.

12. The device of any one of claims 1, 8 or 9 wherein said predetermined function of said distance along said helix is substantially a linear function.

13. The device of any one of claims 1, 8 or 9 wherein said predetermined function of said distance along said helix is substantially a cosine function, the total variation of the argument of said cosine being one-half cycle and the minimum and maximum amplitudes of said variation being at opposite ends of said helix.

14. The device of claims 8 or 9 wherein the total variation of said pitch between opposite ends of said helix is from six percent to 25 percent of the average pitch of said helix and the ratio of finger length variation to pitch variation is in a range from 1.1 to 1.7.

15. The device of claim 14 wherein said total variation of said pitch is approximately 10 percent and said ratio of said finger length variation to said pitch variation is approximately 1.3.

16. The device of claims 8 or 9 wherein the variation of said pitch follows substantially the same function as the variation of said length of said fingers.

17. The device of claim 6 wherein each of said tips of said fingers includes a concave portion conforming to the curvature of the outer periphery of said helix and said spine includes a convex portion conforming to the curvature of the inner periphery of said housing.

18. The device of claim 17 wherein a portion of each of said fingers define a pair of substantially mutually parallel edge surfaces which at their outer tips are coextensive with said spine and are substantially parallel to said longitudinal plane of symmetry.

19. The device of claims 17 or 18 wherein a portion of each of said fingers define a pair of edge surfaces extending radially outward from said helix and symmetrical to said longitudinal plane of symmetry.

20. The device of claim 19 wherein each pair of said radially disposed surfaces subtend an angle of substantially 90 degrees at said axis of said helix.

21. The device of claim 18 wherein said preselected parameter of said support structure is said thickness, where said thickness is defined as said perpendicular distance between said substantially parallel edge surfaces, said thickness on successive ones of said fingers varying along said length of said helix.

22. The device of claim 21 wherein said pitch of said helix increases as said predetermined function of said distance along said helix in said first direction, and said thickness of said successive ones of said fingers decreases along said helix in said first direction.

23. The device of claim 21 wherein said pitch of said helix decreases as said predetermined function of said distance along said helix in said first direction, and said thickness of said successive ones of said fingers increases along said helix in said first direction.

24. The device of claims 22 or 23 wherein said predetermined function of said distance along said helix is a linear function.

25. The device of claims 22 or 23 wherein said predetermined function of said distance along said helix is substantially a cosine function, the total variation of the argument of said cosine being one-half cycle, and the minimum and maximum amplitude of said variation being at opposite ends of said helix.

26. The device of claims 22 or 23 wherein the total variation of said pitch between opposite ends of said helix is in the range from 6 percent to 25 percent of the average pitch of said helix and the ratio of thickness variation to pitch variation is in the range from 1.8 to 2.8.

27. The device of claim 26 wherein said total variation of said pitch is approximately 13 percent and said ratio of thickness variation to pitch variation is approximately 2.3.

28. A traveling wave tube comprising:

(a) means for providing an electron beam directed along an axis;

(b) an electrically conductive slow wave structure including (1) a helix disposed along and about said axis, and (2) a support structure for said helix, said support structure comprising two comb shaped members extending in a direction parallel to the length of said helix and mounted substantially diametrically opposite to said helix so as to form a longitudinal plane of symmetry containing said axis, each comb shaped member having a spine portion and an array of axially spaced-apart fingers projecting from said spine, said fingers connected to the outer periphery of said helix, each finger, as viewed from a direction parallel to said axis, having side portions which diverge away from said helix and are symmetrical to said longitudinal plane of symmetry.

29. The device of claim 28 wherein said preselected parameter of said support structure is the transverse arcuate distance of said edges of said ridge portion.

30. The device of claim 28 wherein said preselected parameter of said support structure is the area, transverse to said axis, of each turn of said ridge portion.

31. The device of claim 28 wherein said preselected parameter of said support structure is the distance, substantially transverse to said axis, between each pair of said substantially opposed edge surfaces.

32. The device of claim 31 wherein said pitch of said helix increases as said predetermined function of said distance along said helix in said first direction, and said predetermined parameter of said support structure decreases as a function of distance along said length of said helix in said first direction.

33. The device of claim 31 wherein said pitch of said helix decreases as said predetermined function of said distance along said helix in said first direction, and said predetermined parameter of said support structure increases as a function of distance along said length of said helix in said first direction.

34. The device of claim 31 wherein said pitch of said helix increases as said predetermined function of said distance along said helix in said first direction, and said predetermined parameter of said support structure decreases as a function of distance along said length of said helix in said first direction.

35. The device of claim 31 wherein said pitch of said helix decreases as said predetermined function of said distance along said helix in said first direction, and said predetermined parameter of said support structure increases as a function of distance along said length of said helix in said first direction.

36. The device of claims 32, 33, 34 or 35 wherein said predetermined function is substantially a linear function.

37. The device of any one of claims 32, 33, 34 or 35 wherein said predetermined function is substantially a cosine, the total variation of the argument of said cosine being one-half cycle and the minimum and maximum amplitudes of said variation being at opposite ends of said helix.

38. The device of any one of claims 1, 7, 17, 28 or 29 wherein said traveling wave tube comprises a plurality of amplifying sections.

39. The device of any one of claims 1, 7, 16, or 28 wherein said helix is a monofilar helix.

40. The device of any ne of claims 1, 7, 17, 29 or 5 wherein said slow wave structure includes two axially interleaved helices, each wound in the same sense and having the same diameter so as to form a bifilar helix.

41. The device of claim 1 wherein a base portion defines said helix and a ridge portion extending substantially radially outwardly from said base portion defines said support structure.

42. The device of claim 41 wherein said ridge portion has a dimension in the direction of said axis which is less than the axial dimension of said base portion.

43. The device of claim 42 wherein said ridge portion is substantially longitudinally centered on said base portion.

44. The device of claims 28 or 42 wherein said preselected parameter of said support structure is a radial dimension of said ridge portion.

45. The device of claim 5 wherein each of said fingers, as viewed from a direction parallel to said axis, has sides which diverge away from said helix towards said housing.

46. The device of claim 18 wherein said preselected parameter of said support structure is a physical dimension of said finger taken at substantially right angles to said plane of symmetry.

47. The device of claims 22 or 23 wherein the variation of said pitch follows substantially the same function as the variation of said thickness of said finger.

48. The device of claim 41 wherein said preselected parameter of said support structure is a peripheral dimension of said ridge portion and peripheral portions of the ridge portion on each of successive turns of the helix are absent on longitudinally staggered but otherwise substantially radially opposed locations along the length of the helix so as to form pairs of substantially opposed edge surfaces of said ridge portion joined at their ends by substantially arcuate edges of said ridge portion.

49. A traveling wave tube comprising:

(a) means for providing an electron beam directed along an axis;

(b) an electrically conductive slow wave structure including (1) a helix disposed along and about said axis; and (2) a support structure comprising two arrays of axially spaced-apart fingers extending in a direction parallel to the length of said helix, each array mounted substantially diametrically opposite to said helix so as to form a longitudinal plane of symmetry containing said axis, the tips of successive ones of said fingers in each of said arrays being connected to respective ones of successive turns of said helix, each finger, as viewed from a direction parallel to said axis, having side portions which diverge away from said helix and are symmetrical to said longitudinal plane of symmetry.

50. The device of claims 48 or 49 wherein each finger has side portions which are substantially parallel to said plane of symmetry.

51. A traveling wave tube comprising:

(a) means for providing an electron beam directed along an axis, said electron beam traveling in a first direction;

(b) an electrically conductive slow wave structure including (1) a helix disposed along and about said axis;

(2) a housing disposed about said helix; and (3) a support structure for said helix;

(c) the pitch of said helix varying as a predetermined function of distance along said helix; and (d) a preselected parameter of said support structure varying as a function of distance along said helix in a set relationship to said varying of said pitch of said helix such that for a first wave traveling along said slow wave structure having its phase velocity and group velocity along said first direction, the change in phase velocity caused by said varying of said pitch tends to cancel the change in phase velocity caused by said varying of said parameter of said support structure so as to result in a sufficiently uniform phase velocity as a function of distance along said slow wave structure to favor amplification of said first wave, whereas for a second wave traveling along said slow wave structure having its phase velocity along said first direction and its group velocity along the opposite direction, the change in phase velocity caused by said varying of said pitch is additive to the change in phase velocity caused by said varying of said parameter of said support structure so as to result in a sufficiently non-uniform phase velocity as a function of distance along said slow wave structure to suppress said second wave.

* * * * *